US005374461A

United States Patent [19]

Bromberg

[11] Patent Number: 5,374,461

[45] Date of Patent: Dec. 20, 1994

[54] ROTATABLE WHEEL ASSEMBLY

[75] Inventor: Howard M. Bromberg, Bronx, N.Y.

[73] Assignee: The Flexi Group, Inc., New York, N.Y.

[21] Appl. No.: 113,209

[22] Filed: Aug. 27, 1993

[51] Int. Cl.[5] ..... G09F 11/04

[52] U.S. Cl. ..... 428/43; 428/65; 428/131; 428/138; 428/201; 40/495; 235/78 R

[58] Field of Search ..... 428/43, 65, 131, 138, 428/195, 201; 40/495; 235/78 R

[56] References Cited

U.S. PATENT DOCUMENTS

| | | | |
|---|---|---|---|
| 1,312,797 | 8/1919 | Mayer | 428/65 |
| 2,932,104 | 4/1960 | Corbett | 40/113 |
| 3,074,609 | 1/1963 | Altshuler et al. | 229/1.5 |
| 3,194,717 | 7/1965 | Albert | 161/113 |
| 3,604,134 | 9/1971 | Clark | 40/70 |
| 3,939,586 | 2/1976 | Clark | 40/70 R |
| 4,323,609 | 4/1982 | Bromberg | 428/65 |
| 4,609,964 | 9/1986 | Sobel | 360/185 |
| 4,742,421 | 5/1988 | Seto et al. | 360/135 |
| 5,017,762 | 5/1991 | Diamond | 235/78 R |

*Primary Examiner*—Alexander S. Thomas
*Attorney, Agent, or Firm*—Norbert P. Holler

[57] ABSTRACT

A rotatable wheel assembly which is suited for use as a wheel calculator, including a wheel having an axial hole therein and bearing indicia on one of its faces, front and back covers between which the wheel is sandwiched, the front cover having a window opening therein for selective viewing of the indicia on the wheel face, and the back cover and the front cover being adhesively bonded to each other through the hole in the wheel, the bond providing a grommetless pivot or axle for the wheel. To inhibit contact between the adhesive bond and the wheel while maximizing the width of the axle relative to the size of the hole in the wheel, a mask having a hole therein which is of substantially the same size as, but not greater than, the hole in the wheel, is interposed between the back cover member and the wheel with the two holes axially aligned with each other. The entire assembly can be formed by machine or by hand, either from a unitary, generally rectangular blank of paperboard or like sheet material, the blank being divided into panels constituting the various components by fold and tear lines, or from such a blank which includes all components of the assembly other than the mask which can be formed from a separate strip of sheet material and individually positioned between the wheel and the back cover member before the blank is folded into its final state.

12 Claims, 3 Drawing Sheets

ROTATABLE WHEEL ASSEMBLY

This invention is directed to wheel calculators, and more particularly to a novel rotatable wheel assembly employed in a wheel calculator, and to a novel blank for making such a rotatable wheel assembly.

BACKGROUND OF THE INVENTION

The present invention is an improvement of the rotatable wheel assembly structures, i.e., the wheel calculators, disclosed and claimed in prior U.S. Pat. No. 4,323,609. As there pointed out, wheel calculators are well known handy informational tools that can be adapted to furnish a variety of data in an easily understandable format. Since the utility of wheel calculators as an informational tool helps assure their preservation, wheel calculators are also effectively used for promotional purposes such as advertising.

Generally speaking, a wheel calculator of one type of construction described in the said prior patent includes a front cover having a window opening provided therein, a back cover usually integral with and folded over against the front cover (although the two covers could be separate elements merely laid over each other), and a rotatable wheel member sandwiched therebetween and bearing indicia selectively viewable through the window opening. One of the covers, usually the back cover, and the wheel member each has a hole therein, the holes being identical in shape and size and in the assembled structure being axially aligned with each other, and a patch of adhesive is located at the outside face of the back cover, the adhesive overlying the hole in the back cover and through the two holes adhesively engaging the inside face of the front cover. Thus, the adhesive, once it is completely set, forms a grommetless axle or pivot about which the wheel member can turn.

In a somewhat simpler alternative construction described in the prior patent, the back cover does not have a hole therein but has an adhesive patch or layer affixed to its inside face over a region the same in size and shape as the hole in the wheel member. In this variant, when the structure is assembled with the hole in the wheel member axially aligned with the adhesive patch or layer, the adhesive engages the inside face of the front cover (or a corresponding application of adhesive affixed to the inside face of the front cover) through the hole in the wheel member and thereby forms the desired grommetless axle or pivot for the wheel member. In this type of construction too, the two covers could be separate elements from each other.

For more specific details of the various forms of wheel calculators, as well as of the different types of materials of which they can be made and of the different methods by which they can be made, reference should be had to the aforesaid prior patent.

In a mass production environment, however, it has been found difficult, especially in the case of the type of construction where neither cover has a hole in it, to provide an adhesive layer or patch on the inside face of one or the other of the two covers which conforms precisely in both size and location to the hole in the wheel member. The problem which has then been encountered is that if the adhesive layer is either larger than or not in exact registry with the hole, the adhesive comes into contact with the edge of the hole or the surface region of the wheel member bounding the hole, with the result that it binds the wheel member and precludes it from turning. While the binding problem can be avoided by making the adhesive application sufficiently smaller in diameter than the hole in the wheel member so as to ensure that the peripheral edge of the adhesive is recessed inwardly from the edge of the hole, it is then found that the pivot or axle structure is necessarily considerably smaller than the hole, which results in the wheel member being loose and jiggling, which in turn may cause the indicia on the wheel member occasionally to be not properly aligned with and hence not clearly viewable through the window opening in the front cover. The wheel calculator then loses some of its attractiveness for both the advertiser and the user.

BRIEF DESCRIPTION OF THE INVENTION

It is the primary object of the present invention to provide grommetless rotatable wheel assemblies suitable for use as wheel calculators, as well as blanks for making such rotatable wheel assemblies, by which the aforesaid drawbacks and disadvantages can be efficaciously avoided.

To this end, the present invention provides a class of rotatable wheel assemblies which, insofar as their basic organizations are concerned, are of the types disclosed in the aforesaid U.S. Pat. No. 4,323,609. Thus, any such wheel assembly includes a pair of generally flat, oppositely disposed, parallel, first and second cover members of substantially the same shapes and sizes and each having an inside face and an outside face. A generally flat wheel member is sandwiched between the inside faces of the cover members and has opposite faces at least one of which bears indicia or items of information thereon, the wheel member having an axis of rotation substantially perpendicular to the wheel member and the cover members and including an axial hole encompassing the axis of rotation, and the axial hole of the wheel member not encompassing any pivot disc that is contiguous with the wheel member. An adhesive layer, patch or similar application is affixed to the inside face of at least the first cover member in a region of the latter juxtaposed to the axial hole of the wheel member for securing the first cover member to the second cover member through the axial hole of the wheel member, such that the adhesive extending from one to the other of the first and second cover members through the axial hole of the wheel member forms a pivot for the wheel member to enable the latter to rotate substantially about the axis of the pivot with respect to the cover members. At least that one of the cover members which is proximate to the at least one face of the wheel member which bears the indicia or items of information is provided with at least one window opening through which the indicia or items of information on the wheel member can be selectively viewed upon rotation of the latter.

Within this context, the combination of features which constitute the improvement characterizing the present invention, comprises that:

(a) the adhesive application on the inside face of the first cover member is greater in area than the axial hole in the wheel member; and (b) a mask member is interposed between the inside face of the first cover member and the proximate one of the faces of the wheel member, the mask member (i) being of a size sufficient to overlie the entire adhesive application and thereby being adhesively bonded to the first cover member, and (ii)

having a hole therein substantially identical in shape with but not greater than the axial hole of the wheel member and located in precise axial alignment with the axial hole of the wheel member. The mask member, (iii) by virtue of its location and construction, ensures that the pivot formed by the portion of the adhesive extending through the hole of the mask member and the axial hole of the wheel member to the inside face of the second cover member substantially fully occupies the axial hole of the wheel member, that any contact between the adhesive application and the proximate face of the wheel member is inhibited, and that apart from the presence of any window openings the outside faces of the first and second cover members are entirely unobstructed by structural components of the wheel assembly that would, if present, interfere with the presentation of graphics on the outside faces of the cover members.

Correspondingly, the present invention contemplates the provision of a blank specially made so as to be suitable for being transformed into a rotatable wheel assembly as described. To this end, the blank is made of a foldable, flexible sheet material capable of having designs, words, symbols and colors printed thereon or otherwise applied thereto, such sheet material, as described in U.S. Pat. No. 4,323,609, preferably being paper, paperboard, plastic sheeting or film, and the like.

In accordance with one embodiment of the invention, the blank is an integral or unitary, generally rectangular (as that term is herein defined) strip of the mentioned sheet material, which strip has a number of transverse fold lines and score or tear lines therein dividing the strip into a series of successively arranged, interconnected panels constituting the various ultimate components of the wheel assembly, namely, the mask member, the front and back cover members, the wheel member and the tab which initially temporarily connects the wheel member to the front cover member and, until the tab is torn off, inhibits rotation of the wheel member. During the formation of the blank, the panels are, of course, modified as required for the purposes of the components of the wheel assembly. Thus, apart from the formulation of the interpanel fold and tear lines and the medial fold line in the tab-forming panel, the mask-forming panel has a hole die-cut into it, the rear cover-forming panel has a layer of adhesive applied to it, the front cover-forming panel has one or more window openings die-cut into it, the wheel-forming panel has an axial hole die-cut into it, a hole is die-cut into the region of juncture of the two cover panels in symmetrically straddling relation to the fold line therebetween (if it should be needed to provide tactile and visual access to the periphery of the wheel when the wheel is sandwiched between the covers), and the requisite items of information or other indicia are applied to the proper faces of the two cover-forming panels and the wheel-forming panel.

In an alternative embodiment of the invention, the blank is formed only with panels constituting all components of the wheel assembly other than the mask. In this case, the mask is formed from a separate strip of sheet material that may be the same as or different from the sheet material used to form the blank, with the so-formed mask then being individually positioned in place over the adhesive application on the back cover before the blank is folded into its final state.

It warrants repetition at this point, that the mask member may be initially a part of the basic blank of sheet material from which the wheel assembly is made, being connected to the portion of the blank constituting the associated one of the cover members along a fold line to enable it to be folded over against the adhesive-bearing inside face of that cover member. Alternatively, the mask member may be a separate item which is first cut from a separate strip or band of sheet material (this sheet material may be the same as or different than the sheet material of which the blank is made, subject only to the requirement that it be capable of adhering to the adhesive on the blank) and then is laid by machine or by hand onto the said portion of the blank into overlying relation to the adhesive patch or layer or other application. Other than that, the only constraints on the mask member are, that it must be large enough to fully overlie the adhesive application and isolate it from the wheel member, and that in the assembled wheel calculator it must be located in the region of the associated cover member which is juxtaposed to the axial hole in the wheel member so that the hole in the mask member is substantially axially aligned with the hole in the wheel member. The mask member in most instances will be somewhat smaller than the proximate one of the cover members, but in principle the mask member may well be just as large as that cover member or possibly even slightly larger. Lastly, it will be understood that if it is desired to apply an adhesive to the inside faces of both cover members, it will then be necessary to interpose a separate mask member between each cover member and the respective proximate one of the opposite faces of the wheel member, but this mask member then must not be large enough to interfere with the viewability of the indicia on the wheel member through the window opening or openings in the proximate cover member.

It will be apparent that the adhesive can be applied to the blank in various different ways, for example, by hand or with the aid of a roller or brush and with or without the use of a stencil, by silk screening techniques, by means of patches or strips of double-faced adhesive tape, and the like. Moreover, the adhesive, when intended to be separately applied to the blank for use in a gluing-type operation, can be of any suitable type, for example, wet, sticky, dry, pressure-sensitive, heat-sensitive, or even a moistenable gum. It is contemplated by the present invention, however, that the grommetless axle-forming adhesion between the front and back cover members can also be effected by heat sealing techniques (as long as the blank is made of heat-sealable sheet material), and thus the terms "adhesion," "adhesive" and "adhesive means" as used herein are intended to designate, and should be interpreted as designating, all structural features of the disclosed wheel assemblies characterized by, as well as all materials used in those assemblies for establishing, the adherence of elements to each other irrespective of how the bonds are formed.

BRIEF DESCRIPTION OF THE DRAWINGS

The foregoing and other objects, characteristics and advantages of the present invention will be more clearly comprehended from the following detailed description thereof when read in conjunction with the accompanying drawings, in which.

DETAILED DESCRIPTION OF THE INVENTION

Figure 6:
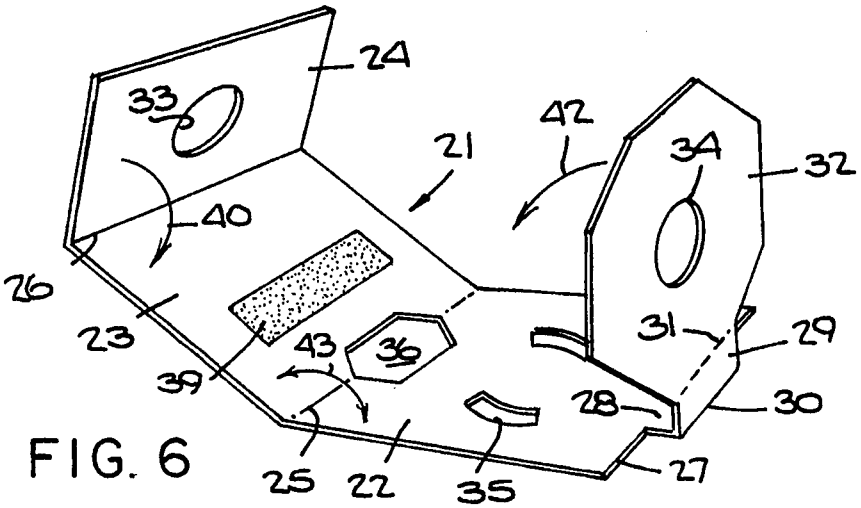
FIG. 6 is a perspective illustration of the initial stages of the manipulation and folding of the blank of FIG. 5 to transform the same into the wheel calculator assembly shown in FIGS. 3 and 4.

Referring now to the drawings in greater detail, the wheel calculator 20 according to the embodiment of FIGS. 1–4 is formed from a precut blank 21 (see FIGS. 5 and 6) made of any suitable, flexible, foldable material such as paper or paperboard, or plastic film or sheeting. The blank is essentially rectangular in configuration and includes, in the illustrated embodiment, two square panels 22 and 23 identical in form and size and a somewhat smaller rectangular panel 24, the three panels being connected in series with each other by fold lines 25 and 26. Attached to the free end edge 27 of the panel 22 by means of a score or tear line 28 is one edge of a small rectangular tab-forming panel 29 which has a fold line 30 medially thereof and is connected at its opposite edge by a score or tear line 31 to an octagonal wheel-forming panel 32 the side-to-side dimensions of which here are substantially equal to the side-to-side dimensions of the panel 22 while at the same time the overall dimension from the fold line 30 to the remote side edge 32*a* of the panel 32 is also substantially equal to the overall dimension from the fold line 30 to the fold line 25.

The panels 24 and 32 are provided with respective holes 33 and 34, respectively, of which the hole 33 is substantially identical in shape but not greater in size than the hole 34, and the panel 22 is provided with one or more window-forming openings 35 (two are shown, merely by way of example). Since the panel 32 is to constitute the wheel member of the ultimate wheel calculator assembly, the hole 34 is precisely centered in the panel 32. On the other hand, since the panel 24 is to constitute the mask member of the assembly, the hole 33 need only be centered on the longitudinal axis of the blank, but it must be located so as to line up coaxially with the hole 34 in the final assembly. In the region of their juncture, the panels 22 and 23 are provided with a hole 36, here shown as having a hexagonal or double trapezoidal configuration, the hole 36 belong symmetrical with respect to the fold line 25 so as to form a pair confronting trapezoidal recesses 37 and 38 in the panels 22 and 23. The reason why the hole 36 is present and the reason why it can be dispensed with under certain circumstances will become clear as the description proceeds. The panel 23 further supports, on what will ultimately be its inside face in the finished wheel calculator, a rectangular layer 39 of adhesive which is located so as to line up with the two holes 33 and 34 when the holes are coaxially aligned with each other, the layer 39 being somewhat greater in size than the holes 33 and 34 but not larger than the panel 24.

Figures 1, 2, 3, 4, 5:
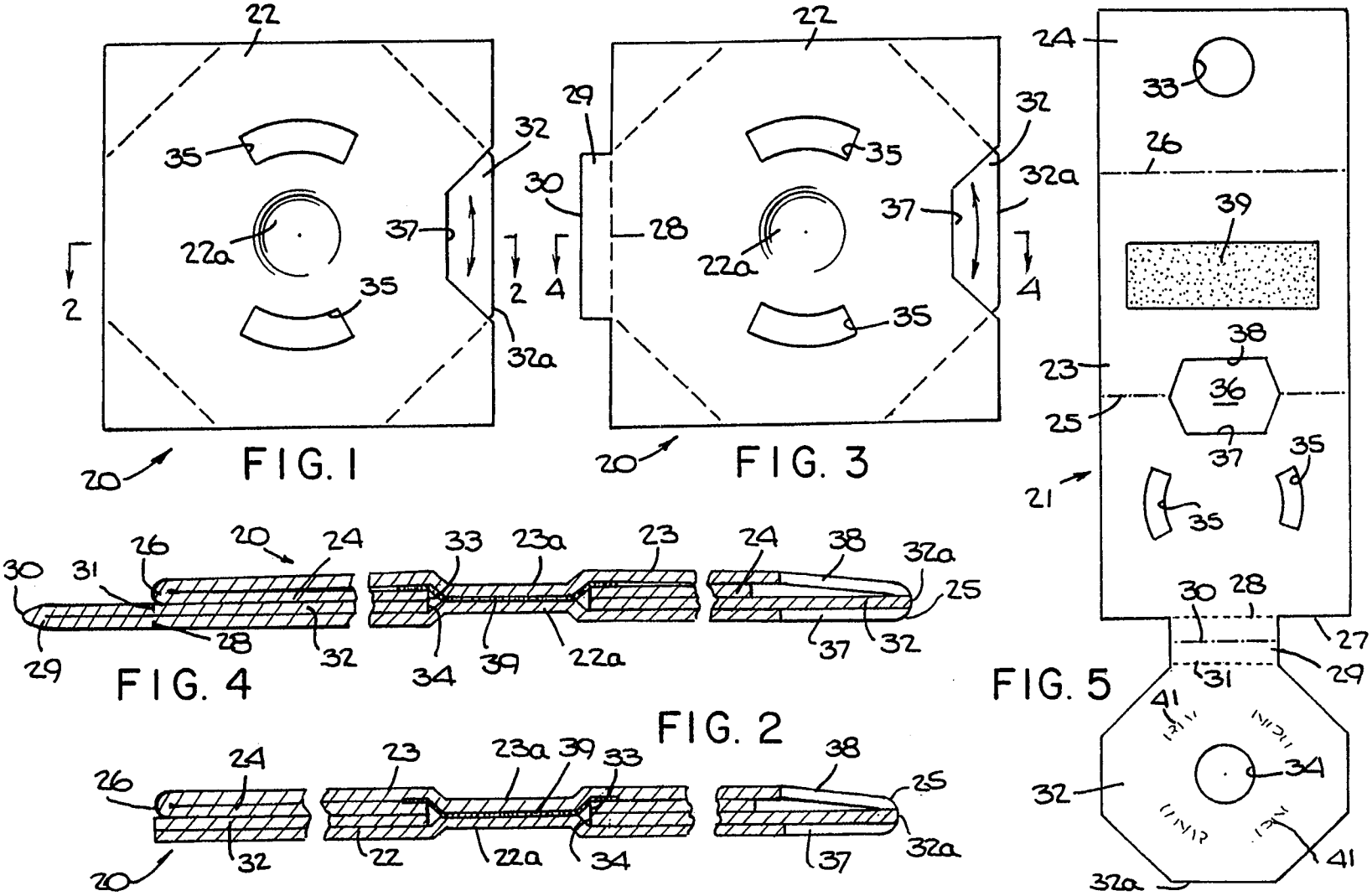
FIG. 1 is a plan view of a wheel assembly constituting a wheel calculator according to one embodiment of the present invention.
FIG. 2 is a sectional view taken along line 2—2 in FIG. 1.
FIG. 3 is a plan view similar to FIG. 1 but shows the wheel calculator in an earlier stage of the assembly thereof than is shown in FIG. 1, with the wheel member still attached to the proximate cover member, in which state the calculator, though not yet functional as such, includes means by which it can be secured to some other structure (for example, to a magazine, newspaper, or other publication as an insert thereto, or to a toy, game, or other structure as an adjunct thereof, etc.) for joint transportation and delivery therewith to a consumer or prospective user.
FIG. 4 is a sectional view taken along the line 4—4 in FIG. 3.
FIG. 5 is a plan view of the unfolded blank of sheet material from which the wheel calculator of FIGS. 1–4 is made and shows the mask member as being an integral part of the blank, connected to the associated cover member along a fold line therebetween.

It will be apparent from the foregoing that when the blank 21 in FIG. 5 is to be transformed into a wheel calculator assembly 20, the first steps are (see FIG. 6) to fold the panel 24 along the fold line 26 in the direction of the arrow 40 over against the "inside" face of the panel 23 so as to have the hole 33 juxtaposed to and in overlying relation to the adhesive layer 39, with the latter at the same time serving to adhesively bond the two panels to each other. Thereafter, the panel 32, which bears indicia or items of information, represented only schematically at 41 in FIG. 5, on that one of its faces which is visible in FIG. 5, is folded, together with the proximate half of the tab-forming panel 29, along the fold line 30 in the direction of the arrow 42 over against the "inside" face of the panel 22. The panel pairs 23/24 and 22/32 are then folded along the fold line 25 in the direction of the arrow 43 over against one another so that the face of the panel 32 which is visible in FIG. 6 but not in FIG. 5 engages the face of the panel 24 which is not visible in either FIG. 5 or FIG. 6. This essentially brings the blank into the condition shown in FIGS. 3 and 4, with the holes 33 and 34 in precise coaxial alignment with each other, after which, as the final step, the regions 22*a* and 23*a* of the panels 22 and 23 overlying the aligned holes 33 and 34 of the panels 24 and 32 are pressed against each other so as to bring the adhesive layer 39 into engagement through the hole 33 in the panel 24 and the hole 34 in the panel 32 with the "inside" face of the panel 22, thereby to establish an adhesive bond between the said regions of the panels 22 and 23.

In this state of the assembly, therefore, the panels 22 and 23 constitute the front and back covers respectively, of the calculator, while the portion of the adhesive layer 39 between the panel regions 22*a* and 23*a* and extending through the aligned holes 33 and 34 of the panels 24 and 32 constitutes, once it is fully set, a grommetless pivot or axle for the wheel member constituted by the panel 32, with the panel 24 serving as a mask member to prevent any part of the adhesive layer from coming into contact with the wheel member. At this point, of course, although the presence of the tab 29 prevents rotation of the wheel member 32 relative to the cover members 22 and 23 and thus retains the calculator in a non-functional state, the tab does have a utilitarian purpose in that it serves as a mounting element for the calculator by means of which the latter can be secured to an associated structure, such as a magazine or newspaper, for example, as a premium or a promotional device. The assembly can then be easily rendered fully functional as a wheel calculator and transformed into the state shown in FIGS. 1 and 2 by simply detaching the folded tab 29 from the panels 22 and 32 along the tear lines 28 and 31, after which the wheel member 32 can be freely rotated about its pivot axle formed by the adhesive 39.

The purpose of the provision of the hole 36 in the blank 21 will now be apparent, namely, that the recesses 37 and 38 formed by that hole constitute a "thumb notch" to provide visual and tactile access to the peripheral region of the wheel member. In other words, they enable a portion of the periphery of the wheel member to be accessible to the user's eyes and fingers when rotation of the wheel member is desired, whether to view selected items of the indicia 41 through one or both of the window openings 35 in the front cover member 22, or to view additional indicia and information which may be present in the peripheral region of the wheel member.

The present invention, therefore, provides a number of advantages. The incorporation of the mask member 24 in the assembly with its hole 33 precisely aligned with the hole 34 in the wheel member ensures that none of the adhesive used to bond the front and rear covers to one another and to constitute the grommetless axle or pivot for the wheel member 32 can come into contact with the surface of the wheel member and bind the same so as to interfere with its ability to rotate. At the same time, the presence of the mask member makes it possible to maximize the area of contact of the adhesive carried by the back cover member with the inside face of the front cover member so that the resultant axle fills almost the entire area of the hole 34 in the wheel member and effectively eliminates any looseness of the wheel member which could cause it to jiggle and might on occasion cause some of the indicia or information 41 on the wheel member to be out of proper alignment with one or the other of the window openings 35 in the front cover member. Such an occurrence would, of course, render the wheel calculator less pleasing to the user and hence and less valuable as a promotional or informational item. Also, since the mask member enables the adhesive layer 39 to be positioned on the inside face of the back cover member 23, the outside face of the latter remains completely unobstructed by any structural element and thus can be used for showing additional graphics, which may be either design elements or instructional texts or advertisements or the like.

It should be noted, in this connection, that the depressed regions 22*a* and 23*a* of the front and back cover members have been shown on a greatly exaggerated scale in FIGS. 2 and 4; in an actual wheel calculator assembly of this type, the presence of the depressed regions will not interfere with the quality of any graphics because the depression on either cover member is ordinarily less than 1 mm deep, especially given the fact that the sheet material (most likely paper or paperboard) of which the calculator is made will itself be less than 1 mm thick. It will also be understood, that, although the adhesive layer 39 has been illustrated as being in the form of a rectangular strip, it could just as well be of a circular or otherwise configured form, subject only to the constraint that it must be smaller than the mask member 24 but larger than the hole 33 in the mask member.

Figure 9:
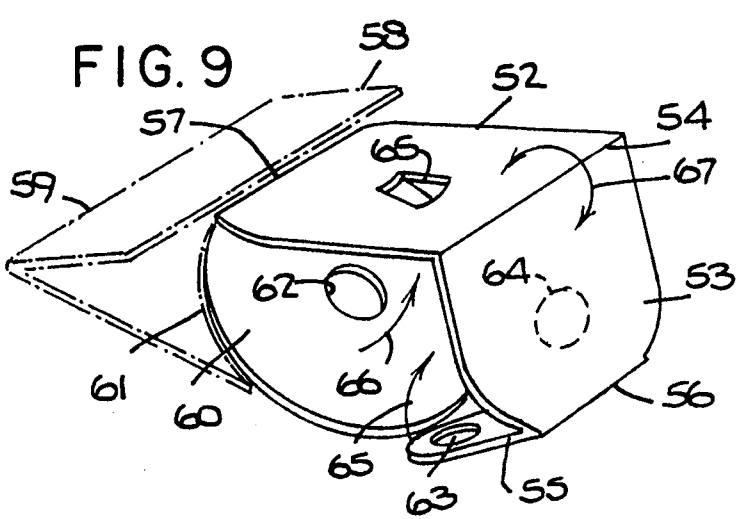
FIG. 9 is a perspective illustration of the manipulation and folding of the blank of FIG. 8 to transform the same into the wheel calculator assembly shown in FIG. 7.
Figure 7:
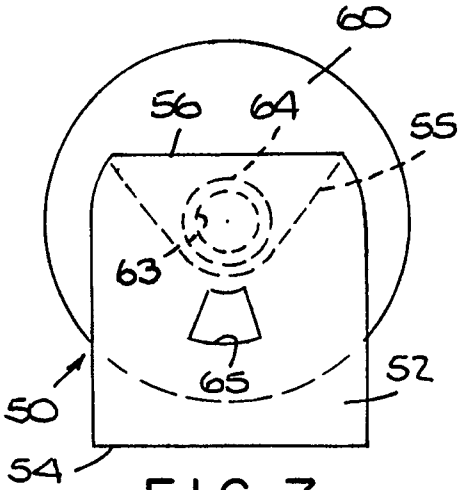
FIG. 7 is a plan view of a wheel calculator assembly according to another embodiment of the present invention.
Figure 8:
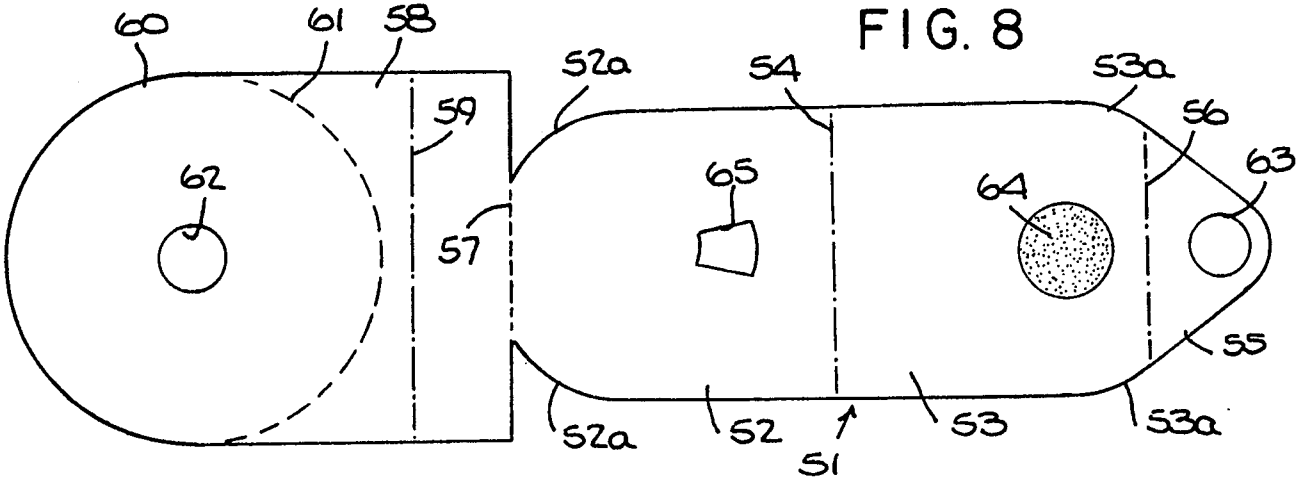
FIG. 8 is a plan view of the unfolded blank of sheet material from which the wheel calculator assembly of FIG. 7 is made.

Referring now to FIGS. 7, 8 and 9, the wheel calculator assembly 50 there shown is made from an elongate, generally rectangular, precut blank 51 which includes two generally rectangular panels 52 and 53 of substantially equal lengths, which are connected to one another along a fold line 54, and a third generally triangular panel 55 connected with the panel 53 along a fold line 56. It will be understood that the panel 55 need not be triangular in shape and could be considerably larger than is shown. At its end remote from the fold line 54, the panel 52 is connected by a score or tear line 57 to a tab-forming panel 58 which at a short distance from the tear line 57 is provided with a fold line 59 and to which, in the region thereof beyond the fold line 59, a circular panel 60 is connected by a circularly curved score or tear line 61. The panel 60, which is to constitute the wheel member of the calculator assembly 50 and the diameter of which is greater than the width and length dimensions of the panels 52 and 53, has an axial hole 62 therein, while correspondingly the panel 55, which is to constitute the mask member, has a centered hole 63 therein. The holes 62 and 63 are so arranged that they will be coaxially aligned with one another when the mask member 54 is folded over against the back cover member 53 and the wheel member is properly positioned between the cover members 52 and 53. The back cover member 53 also supports an adhesive layer 64 which, in this embodiment of the invention, is shown to be circular in configuration but could obviously be otherwise shaped.

It will be apparent that it is only because of the design characteristics imposed upon the wheel calculator 50, namely, the provision of the curved end corner regions 52*a* and 53*a* of the panels 52 and 53, that the mask-forming panel 55 has been shown as being essentially triangular in out-line. In such an assembly, therefore, it follows that the size of the adhesive layer 64 must be smaller than the overlying area of the panel 55 while still being somewhat larger than the hole 63 in the mask member. The panel 52, which is to constitute the front cover member of the wheel calculator, is shown as being provided with a generally trapezoidally shaped window opening 65, although this opening could be otherwise shaped and more than one such opening could be provided in the panel 52.

It should be noted that the form of the blank 51 shown in FIG. 8 is not strictly a rectangle. Nevertheless, because it is an elongate strip of mostly parallel-sided sheet material, it is deemed to be of "generally rectangular" shape, and that term should be interpreted herein as denoting all the disclosed blanks shown in FIGS. 5–6, 8–9 and 10 regardless of the configurations of their respective mask member-forming and wheel member-forming end panels.

To effect the transformation of the blank 51 into the finished wheel calculator assembly 50, the first step is to fold the panel 55 along the fold line 56 over against the "inside" face of the panel 53 in the direction of the arrow 65 shown in FIG. 9, so as to bring the panel 55 up against the adhesive layer 64. Concurrently, the section of the tab-forming panel 58 bearing the circular panel 60 is folded along the fold line 59, as indicated by the arrow 66 in FIG. 9, over and against the remaining half of the panel 58 so as to dispose the panel 60 against the "inside" face of the front cover-forming panel 52. The panel pairs 52/60 and 53/55 are then folded along the fold line 54 toward one another, as indicated by the arrow 67 in FIG. 9, by virtue of which the hole 63 in the panel 55 ends up in coaxial alignment with the hole 62 in the panel 60. The regions of the panels 52 and 53 overlying the aligned holes 62 and 63 are then pressed toward one another, as previously explained with respect to the embodiment of FIGS. 1–4, to cause the adhesive 64 to engage the inside face of the panel 52 through the holes 63 and 62 so as to form, when fully set, the desired grommetless pivot or axle for the panel 60 constituting the wheel member. At this time, of course, the wheel calculator is still non-functional as a calculator, with the wheel member 60 unable to rotate relative to the cover members, but the still existing tab 58 again has the utilitarian purpose of enabling the assembly to be suitably secured to or mounted in a magazine or newspaper or other structure with which the calculator is to be presented to the public. Ultimately, the tab is removed by being torn on the one hand along the tear line 57 and on the other hand along the tear line 61, at which point the wheel member 60 will remain in position as shown in FIG. 7 and will be rotatable about its axle or pivot to bring selected items of intelligence or other indicia into the range of the window opening or openings 65 in the front cover member 52.

It will have been noted that in the wheel calculator of this embodiment of the invention there is no hole (corresponding to the hole 36 in the embodiment of FIGS. 1–6) provided in the juncture region of the panels 52 and 53. This is obviously because the size of the wheel member 60 is such that its periphery is accessible to the user beyond the boundaries of the cover members 52 and 53. The wheel member could, of course, be made smaller in diameter than the side-to-side dimensions of the cover members, but in that case it would be necessary to provide a "thumb notch" hole (not shown) corresponding to the hole 36 in the blank 51 at and symmetrical with the fold line 54, which hole might, for example, be oval in form but could be otherwise shaped as well, so as to enable the user to have access to the periphery of the wheel member for rotating it.

Figure 10:
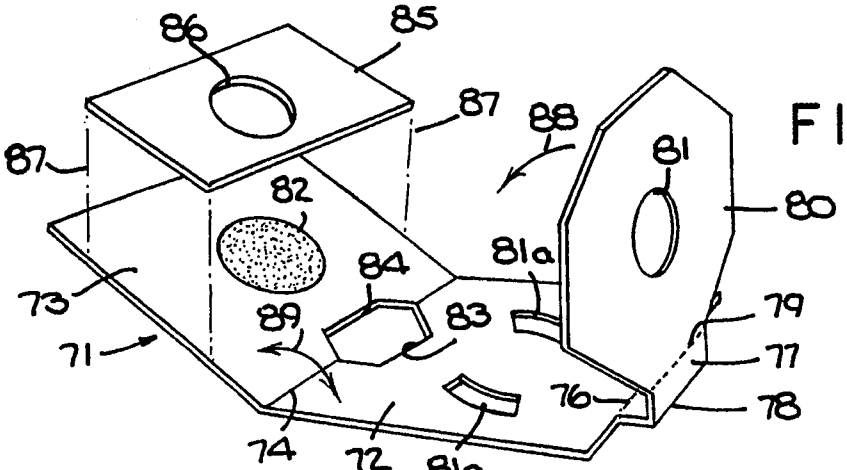
FIG. 10 is a perspective illustration of the manipulation and folding of a blank of sheet material into the form of a wheel calculator similar to the one shown in FIGS. 1–4, the blank of FIG. 10 being essentially similar to the blank shown in FIGS. 5 and 6 except that, in accordance with another embodiment of the present invention, the mask member in FIG. 10 is a separate strip or panel of sheet material.
Figure 11:
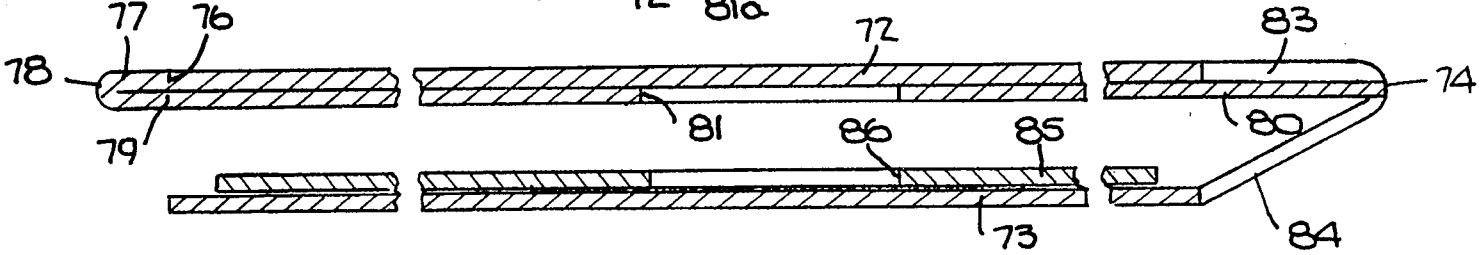
FIG. 11 represents a longitudinal central section through the blank of FIG. 10 and shows the same in an initial folded stage thereof.
Figure 12:
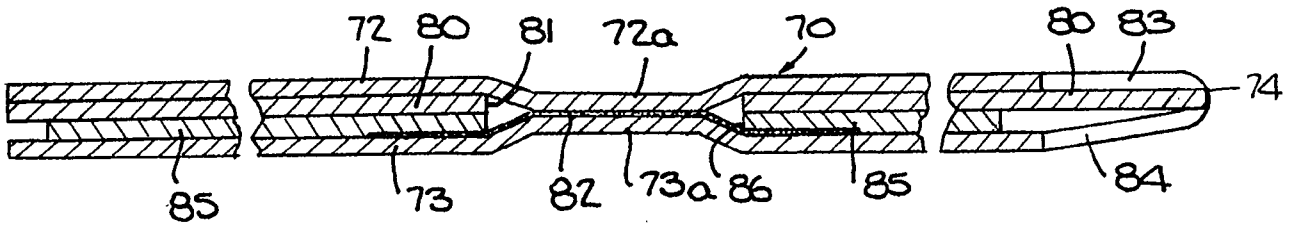
FIG. 12 is a sectional view similar to FIG. 11 but shows the final folded stage of the blank and the finished stage of the wheel calculator assembly constituted thereby.

The wheel calculator 70 according to the embodiment of the present invention illustrated in FIGS. 10, 11 and 12 is basically similar to the embodiment of FIGS. 1–6 with one principal exception. As shown in FIG. 10, the wheel calculator 70 is constructed from a generally rectangular precut blank 71 having, like the blank 21 shown in FIG. 5, a panel 72 to constitute the front cover member of the calculator and a panel 73 to constitute the back cover member of the calculator, the two panels being foldably connected to one another along a fold line 74. Connected to the free end edge 75 of the panel 72 along a score or tear line 76 is a tab-forming panel 77 having a medial fold line 78 therein, and attached to the panel 77 by a score or tear line 79 is an octagonal panel 80 having a central hole 81 therein and intended to constitute the wheel member of the calculator 70. As before, the panel 72 is provided with a pair of window openings 81, the panel 73 supports a layer or application 82 of adhesive (which is here shown to be of circular configuration although it could just as well be of rectangular shape as in FIGS. 5 and 6 or even of any other desired form), and the panels 72 and 73 in the region of their juncture are provided with matched trapezoidal "thumb notch" recesses 83 and 84.

The sole difference between the blank 71 shown in FIG. 10 and the blank 21 shown in FIG. 5 is that in FIG. 10 a panel 85 intended to constitute the mask member is provided which is initially formed not as an integral part of the blank but rather as a separate element. The panel 85 may be made of the same sheet material as the remainder of the blank or of any other comparable sheet material, subject only to the constraint that it must be capable of bonding to the adhesive 82. As shown, the panel 85 is somewhat smaller in width than the panel 73 (although the panel 85 could be as wide as or wider than the panel 73 as long as when it in its assembled position it does not block the recess 84) and is provided with a central hole 86 which is somewhat smaller than the adhesive layer 82 but at most of the same size as the hole 81 in the panel 80.

In the construction of the wheel calculator assembly 70 shown in FIG. 12, the first step is to lay the panel 85 down onto the panel 73 of the blank 71, as indicated by the dot-dash lines 87, so as to adhere the panel 85 to the panel 73 by the adhesive 82. Here, of course, the manufacturer must be careful to ensure that the panel 85 constituting the mask member is properly positioned on the panel 73, for example, with the aid of suitable markings (graphic, embossed or otherwise) not shown in FIG. 10 but provided on the "inside" face of the panel 73 if the laydown of the panel 85 is made by hand or with aid of appropriate control systems if the laydown is made by machine, so that the hole 86 is fully within the region of the adhesive layer 82 and will ultimately be in precise coaxial alignment with the hole 81 in the wheel member 80. (Such care, it should be noted, is essential because the mask member is a separate element from the blank; where the mask member is a properly delineated integral part of the blank, the proper positioning of the mask member and its hole is inherently effected by the folding of the mask-forming panel.) Concurrently, the tab-forming panel 77 is folded along its medial fold line 78, as indicated by the arrow 88 in FIG. 10, to dispose the panel 80 against the "inside" face of the panel 72. The panel pairs 72/80 and 73/85 are then folded along the fold line 74, as indicated by the arrow 89, until the assembly is in the preliminary form illustrated (on a greatly exaggerated scale) in FIG. 11. The assembly is then flattened into the final shape shown in FIG. 12 at which time also the regions **72*a* and 73*a* of the front and back cover members 72 and 73 are pressed against each other to cause the adhesive 82 to bond against the "inside" face of the front cover member and, when fully set, to constitute the desired grommetless pivot or axle for the wheel member 80**.

It will be understood that the foregoing description of various embodiments of the present invention is for purposes of illustration only, and that the herein disclosed structural and operational features of the wheel assemblies according to the present invention are susceptible to a number of modifications and changes, none of which entails any departure from the spirit and scope of the present invention as defined in the hereto appended claims. Moreover, it will be clear to those skilled in the art that a wheel calculator assembly of any of the types herein disclosed can be readily produced by machinery operated either in a continuous line process (web fed) or in an individual or batch process (sheet fed). Alternatively, of course, such a wheel calculator can also be produced manually (hand folding and gluing).

We claim:

1. A rotatable wheel assembly which includes a pair of generally flat, oppositely disposed, parallel, first and second cover members of substantially the same shapes and sizes and each having an inside face and an outside face, a generally flat wheel member sandwiched between said inside faces of said cover members and having opposite faces at least one of which bears indicia or items of information thereon, said wheel member having an axis of rotation substantially perpendicular to said wheel member and said cover members and including an axial hole encompassing said axis of rotation, said axial hole of said wheel member not encompassing any pivot disc that is contiguous with said wheel member, and adhesive means provided at said inside face of at least said first cover member in a region of the latter juxtaposed to said axial hole of said wheel member, the adhesive means securing said first cover member to said second cover member through said axial hole of said wheel member such that the adhesive means extending from one to the other of said first and second cover members through said axial hole of said wheel member forms a pivot for said wheel member to enable the latter to rotate substantially about said axis with respect to said cover members, at least that one of said cover members which is proximate to said at least one face of said wheel member being provided with at least one window opening through which said indicia or items of information on said wheel member can be selectively viewed upon rotation of the latter; wherein the improvement comprises that:

(a) said adhesive means is greater in area than said axial hole in said wheel member; and (b) a mask member is interposed between said inside face of said first cover member and the proximate one of said faces of said wheel member, said mask member (i) being of a size sufficient to overlie the entire adhesive means, (ii) having a hole therein fully overlaid by said adhesive means and substantially identical in shape with but not greater than said axial hole of said wheel member and located in precise axial alignment with said axial hole of said wheel member, and (iii) by virtue of its location and construction, ensuring that said pivot formed by the portion of said adhesive means extending through said hole of said mask member and said axial hole of said wheel member substantially fully occupies said axial hole of said wheel member, that any contact between said adhesive means and said proximate face of said wheel member is inhibited, and that apart from the presence of any window openings said outside faces of said first and second cover members are entirely unobstructed by structural components of the wheel assembly that would interfere with the presentation of graphics on said outside faces.

2. A rotatable wheel assembly as claimed in claim 1, wherein said mask member, said first and second cover members and said wheel member are, prior to the formation of said wheel assembly, parts of an integral, elongate, generally rectangular, foldable blank which includes means initially fixedly interconnecting said second cover member and said wheel member to temporarily preclude rotation of said wheel member relative to said cover members, said interconnecting means having weakened portions at its junctures with said wheel member and said second cover member and being adapted thereby to be torn away to release said wheel member for rotation.

3. A rotatable wheel assembly as claimed in claim 2, wherein said interconnecting means comprises a tab connected at opposite side edges thereof by a pair of tear lines to said second cover member and said wheel member, respectively, and folded about a midline of said tab, said tab thereby preventing rotation of said wheel member while providing a means by which said wheel assembly can be connected to a supporting structure for distribution to potential users of said wheel assembly.

4. A rotatable wheel assembly as claimed in claim 1, wherein said first and second cover members and said wheel member are, prior to the formation of said wheel assembly, parts of an integral, elongate, generally rectangular, foldable blank which includes means initially fixedly interconnecting said second cover member and said wheel member to temporarily preclude rotation of said wheel member relative to said cover members, said interconnecting means having weakened portions at its junctures with said wheel member and said second cover member and being adapted thereby to be torn away to release said wheel member for rotation, and said mask member is an element separate from said blank and is individually placed into juxtaposition to said first cover member and said adhesive means prior to the folding of said blank.

5. A rotatable wheel assembly as claimed in claim 4, wherein said interconnecting means comprises a tab connected at opposite side edges thereof by a pair of tear lines to said second cover member and said wheel member, respectively, and folded about a midline of said tab, said tab thereby preventing rotation of said wheel member while providing a means by which said wheel assembly can be connected to a supporting structure for distribution to potential users of said wheel assembly.

6. A rotatable wheel assembly as claimed in claim 1, wherein said cover members at their regions of juncture with one another are provided with opposed corresponding recesses extending in depth from said juncture into said cover members to a distance from said axis of rotation of said wheel member smaller than the radial dimension of said wheel member, for providing visual and tactile access to the peripheral region of said wheel member.

7. A rotatable wheel assembly as claimed in claim 6, wherein said mask member, said first and second cover members and said wheel member are, prior to the formation of said wheel assembly, parts of an integral, elongate, generally rectangular, foldable blank which includes means initially fixedly interconnecting said second cover member and said wheel member to temporarily preclude rotation of said wheel member relative to said cover members, said interconnecting means having weakened portions at its junctures with said wheel member and said second cover member and being adapted thereby to be torn away to release said wheel member for rotation.

8. A rotatable wheel assembly as claimed in claim 6, wherein said first and second cover members and said wheel member are, prior to the formation of said wheel assembly, parts of an integral, elongate, generally rectangular, foldable blank which includes means initially fixedly interconnecting said second cover member and said wheel member to temporarily preclude rotation of said wheel member relative to said cover members, said interconnecting means having weakened portions at its junctures with said wheel member and said second cover member and being adapted thereby to be torn away to release said wheel member for rotation, and said mask member is an element separate from said blank and is individually placed into juxtaposition to said first cover member and said adhesive means prior to the folding of said blank.

9. A rotatable wheel assembly as claimed in claim 1, wherein said first and second cover members and said wheel member are all constituted by a series of successively arranged respective panels of an integral elongate blank in which said panels constituting said first and second cover members are connected to each other along a fold line therebetween, and said panel constituting said wheel member is connected to said panel constituting said second cover member along two tear lines spaced from each other and said fold line and located at a pair of opposed boundary edges of a medially foldable tab interposed between said wheel member and said second cover member.

10. A rotatable wheel assembly as claimed in claim 1, wherein said mask member, said first and second cover members and said wheel member are all constituted by a series of successively arranged respective panels of an integral elongate blank in which said panel constituting said mask member is connected to said panel constituting said first cover member along a first fold line therebetween, said panels constituting said first and second cover members are connected to each other along a second fold line therebetween spaced from said first fold line, and said panel constituting said wheel member is connected to said panel constituting said second cover member along two tear lines spaced from each other and said second fold line and located at a pair of opposed boundary edges of a medially foldable tab interposed between said wheel member and said second cover member.

11. A blank of flexible, foldable sheet material for making a rotatable wheel calculator assembly which has a front cover member and a back cover member having respective inside faces directed toward each other, a rotatable wheel member sandwiched between said cover members and having an axis of rotation and front and back faces directed toward said front and back cover members, respectively, a mask member sandwiched between said inside face of said back cover member and said back face of said wheel member, with each of said wheel member and said mask member having therein a respective circular hole both of which are coaxially aligned with each other and are centered on said axis of rotation, and adhesive means interconnecting said front and back cover members through said holes and constituting a grommetless axle for said wheel member;

said blank being an integral, elongate, generally rectangular strip of said sheet material having transverse fold lines and tear lines therein dividing said strip into a series of panels, including (a) a first panel which is to constitute said mask member and has opposite side edges and a first hole centered between said side edges, (b) a second panel which is to constitute said back cover member and is connected to said first panel by a first fold line, (c) a third panel which is to constitute said front cover member and is connected to said second panel by a second fold line spaced from said first fold line and has at least one window opening therein laterally offset from the intersection of said third panel with said axis of rotation of said wheel member, (d) a fourth panel which is to constitute a tab and is connected to said third panel by a first tear line spaced from said second fold line and has a medial third fold line spaced from said first tear line, and (e) a fifth panel which is to constitute said wheel member and is connected to said fourth panel by a second tear line spaced from said third fold line and said first tear line and has a central second hole aligned longitudinally of said blank with said first hole, (f) said first and fifth panels being adapted to be folded along said first and third fold lines, respectively, over against said second and third panels, respectively, said first and second panels as a unit and said third and fifth panels as a unit being adapted to be folded along said second fold line over against each other, and said fourth panel upon being folded over against itself along said third fold line as a concomitant of the folding of said fifth panel against said third panel being adapted to be separated from said third and fifth panels by tearing along said first and second tear lines to release said fifth panel for rotation relative to said first, second and third panels.

12. A blank as claimed in claim 11, wherein said second and third panels are provided, at their region of juncture along said second fold line, with a third hole aligned longitudinally of said blank with said first and second holes, said third hole symmetrically straddling said second fold line to define corresponding recesses in said second and third panels for providing visual and tactile access to the peripheral region of said wheel member when the latter is confined between said front and back cover members.

* * * * *